US010112748B2

(12) United States Patent
Peters

(10) Patent No.: US 10,112,748 B2
(45) Date of Patent: Oct. 30, 2018

(54) ONE-HANDED OPERATION BOTTLE DEVICE

(71) Applicant: Jason Peters, Wheat Ridge, CO (US)

(72) Inventor: Jason Peters, Wheat Ridge, CO (US)

( * ) Notice: Subject to any disclaimer, the term of this patent is extended or adjusted under 35 U.S.C. 154(b) by 0 days.

(21) Appl. No.: 15/425,203

(22) Filed: Feb. 6, 2017

(65) Prior Publication Data

US 2017/0233153 A1 Aug. 17, 2017

Related U.S. Application Data

(60) Provisional application No. 62/295,943, filed on Feb. 16, 2016.

(51) Int. Cl.
*B65D 47/24* (2006.01)
*B65D 23/10* (2006.01)

(52) U.S. Cl.
CPC ..... *B65D 47/249* (2013.01); *B65D 23/10* (2013.01)

(58) Field of Classification Search
CPC ..... B65D 51/16–51/1672; B65D 1/02; B65D 41/02; B65D 23/10–23/104; B65D 25/28–25/32; B65D 33/06–33/08; B65D 33/14; B65D 39/16; B65D 63/18; B65D 2525/28
USPC ..... 220/212.5, 317, 318, 846, 696, 710.5, 220/741, 752–776
See application file for complete search history.

(56) References Cited

U.S. PATENT DOCUMENTS 3,321,115 A * 5/1967 Rendahl ..... A47J 41/0011 222/473
3,558,023 A * 1/1971 Yoshito ..... A47J 41/0027 220/756
3,847,311 A 11/1974 Flores et al.
4,609,124 A 9/1986 Malloy
5,273,194 A * 12/1993 McNamara ..... B65D 51/04 220/321
5,711,452 A 1/1998 Chaffin
8,590,731 B2 11/2013 Pinelli
8,844,746 B2 9/2014 Meyers et al.
9,282,836 B2 * 3/2016 Nishijima ..... A47G 19/12

* cited by examiner

*Primary Examiner* — Kareen Thomas
(74) *Attorney, Agent, or Firm* — Trenner Law Firm, LLC; Mark D. Trenner

(57) ABSTRACT

A bottle device is disclosed. An example bottle device includes a housing to contain a liquid therein, and an opening in the housing. A cover rotates between an open position and a closed position over the opening to selectively release the liquid from the housing. A switch is connected to the cover via a switch arm, a connecting arm, and a primary link arm to move a switch arm between a first position and a second position corresponding to the open position and the closed position of the cover.

25 Claims, 20 Drawing Sheets

ONE-HANDED OPERATION BOTTLE DEVICE

PRIORITY CLAIM

This application claims the benefit of U.S. Provisional Patent Application No. 62/295,943 filed Feb. 16, 2016 titled "One-handed operation bottle device" of Jason Peters, hereby incorporated by reference in its entirety as though fully set forth herein.

BACKGROUND

Water containers have been around perhaps as long as humans have walked on dry land. Even a closable, reusable water bottle has been available as a canteen for well over a hundred years. Although the availability of household water supplies reduced the need for individual water containers in the twentieth century, by the mid to late twentieth century the use of water bottles proliferated once again for use in sports, workouts, and outdoor activities (e.g., hiking and biking).

DETAILED DESCRIPTION

A bottle device (or "container") for water or drink (e.g., any liquid) is disclosed. An example bottle device includes a switch linkage that pulls down on a main linkage. The main linkage is axially fixed to the bottle and pulls down on the second link to drive the main linkage. The linkages may include pins with retaining rings. The primary sealing component is a disc which has a seal (e.g., molded silicon). The disc is located on the shaft (e.g., by a retaining ring), and is rotated in place by the main shaft. The disc and bottle together form a butterfly valve (e.g., triple offset design). The shaft is loaded by a torsion spring (e.g., about 360 degrees at rest).

The bottle device may be opened by rotating the disc seating (e.g., by about 90 degrees at the time). In an example, the bottle device is fully opened when the switch is pushed all the way down, allowing flow of the liquid to pass.

In an example, the pull button switch linkage enables opening/closing the seal, providing a wide mouth opening for easy, fast consumption (e.g., "gulping") or pouring the water or other liquid. In an example, the user only needs one hand to operate the bottle device.

Before continuing, it is noted that as used herein, the terms "includes" and "including" mean, but is not limited to, "includes" or "including" and "includes at least" or "including at least." The term "based on" means "based on" and "based at least in part on."

Figure 1:
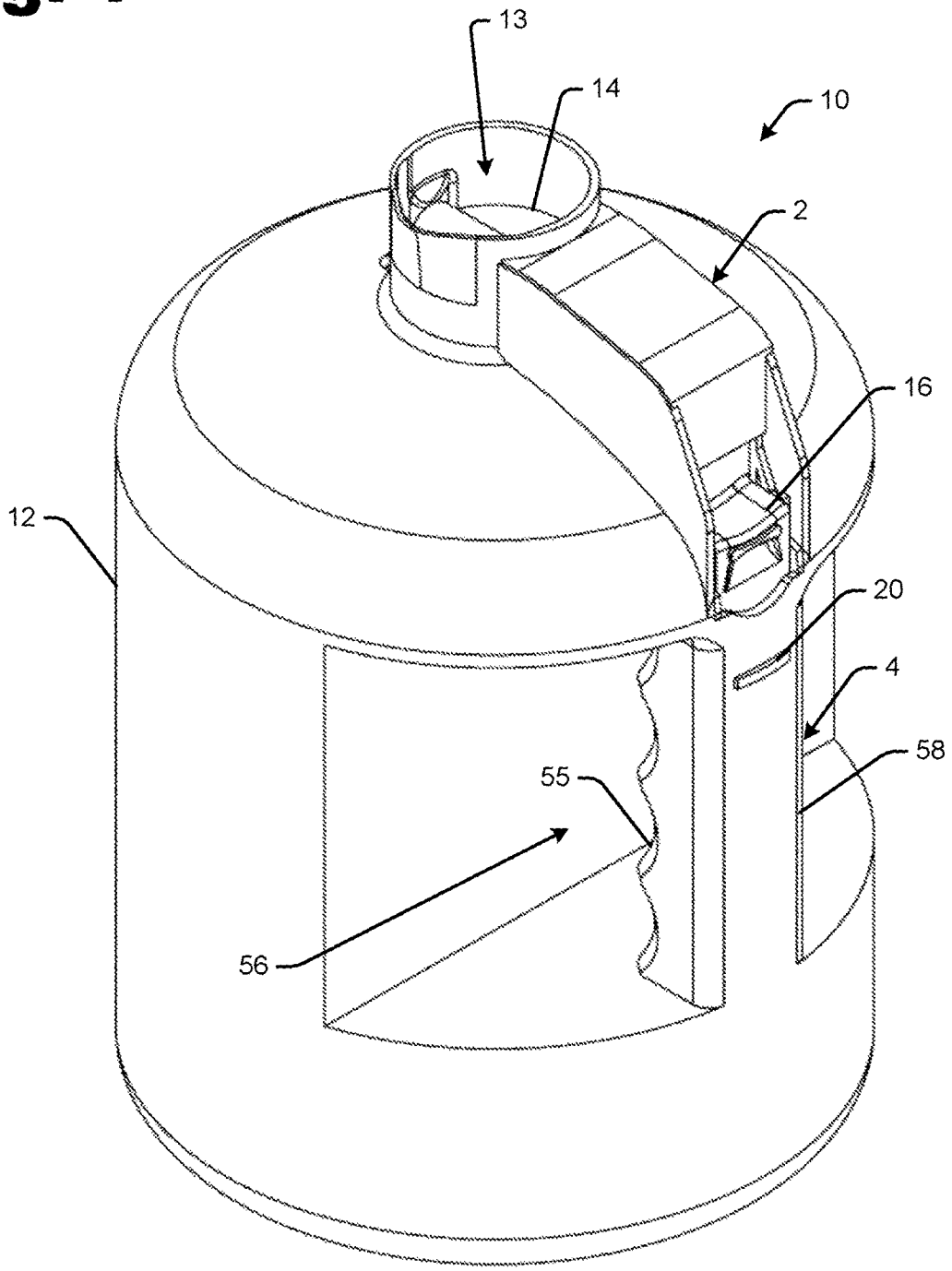
FIG. 1 is a perspective view of an example bottle device in a closed and unlocked configuration.
Figure 2:
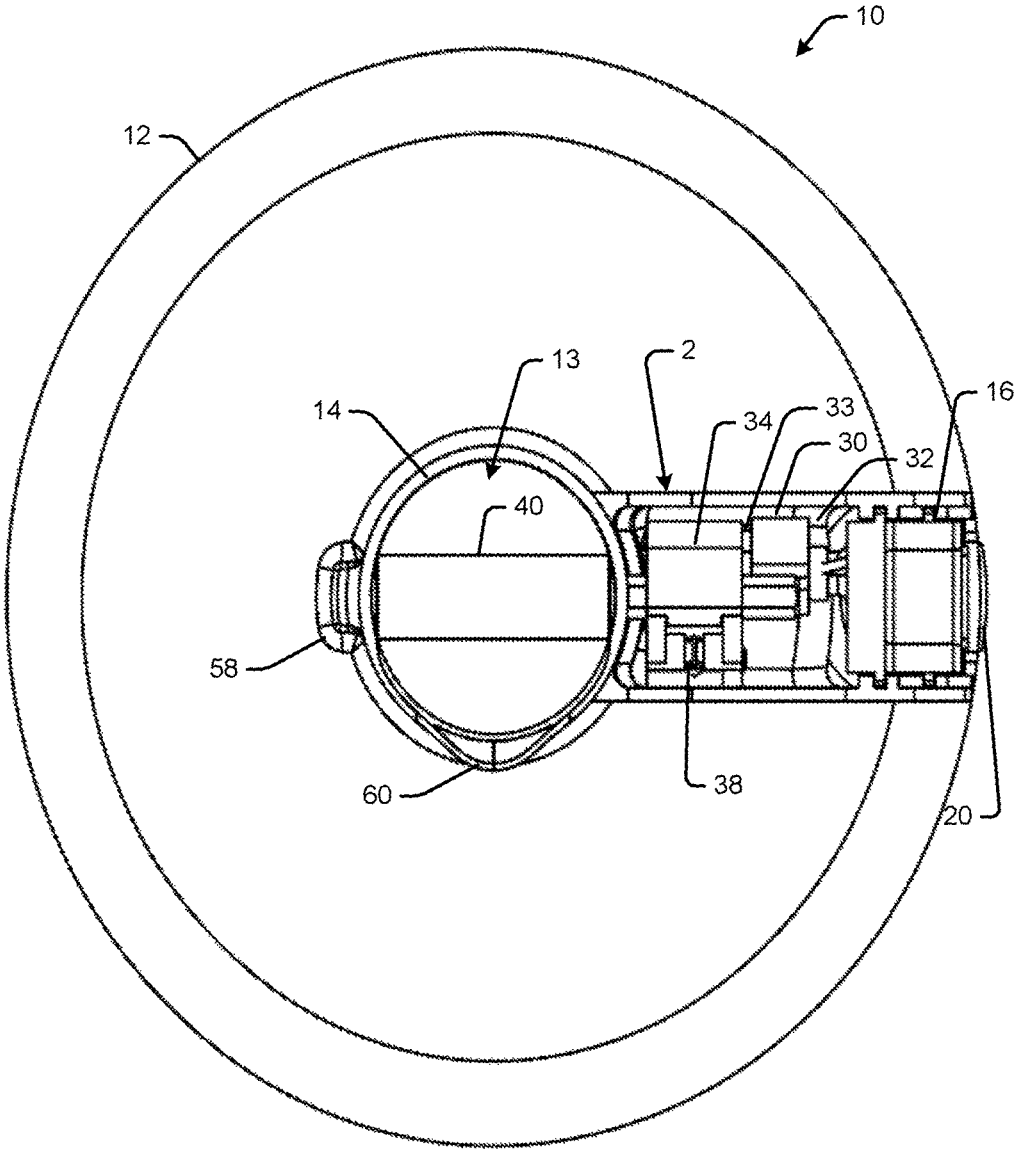
FIG. 2 is a top view of the example bottle device in a closed and unlocked configuration corresponding to FIG. 1.
Figure 3:
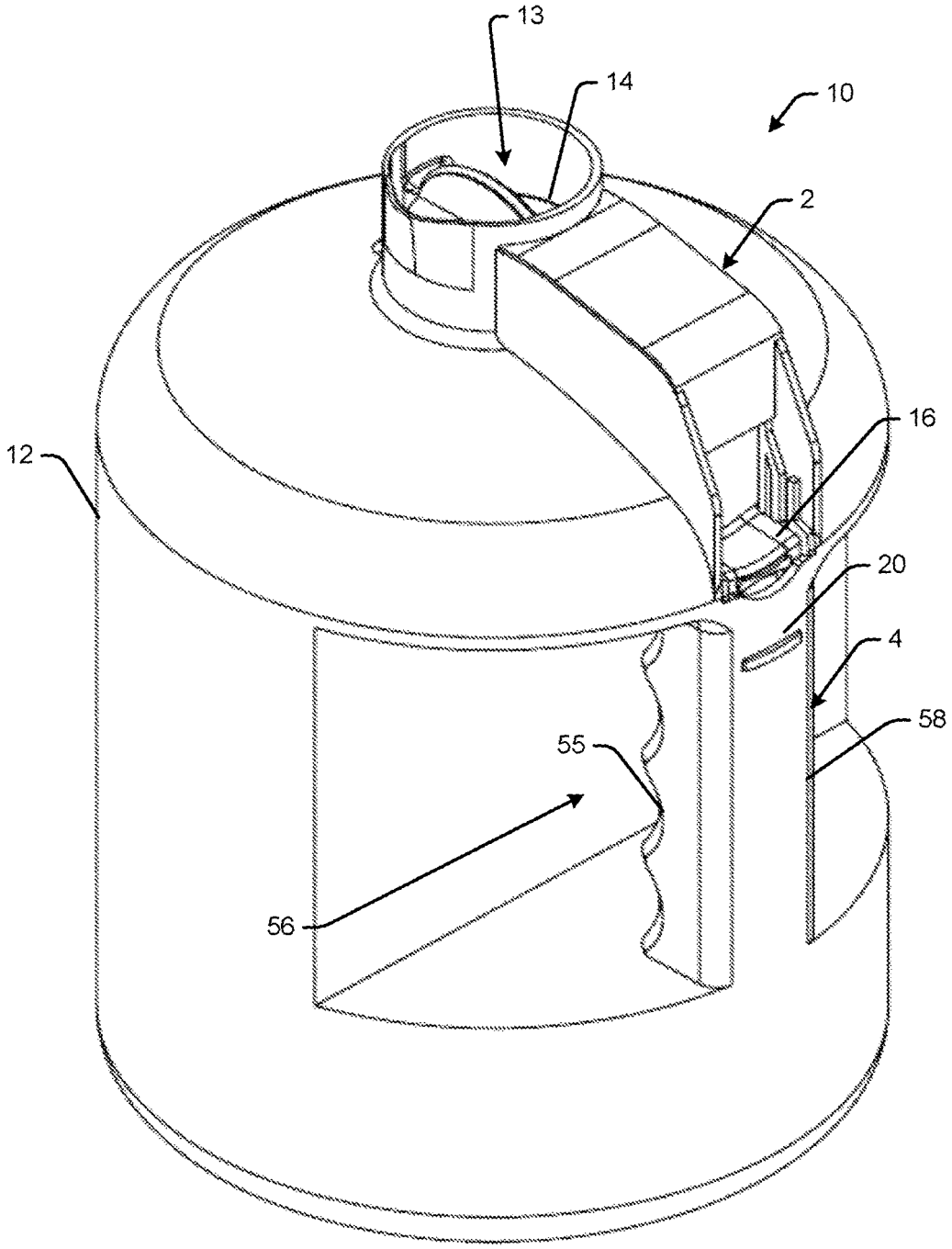
FIG. 3 is a perspective view of the example bottle device in an open and unlocked configuration.
Figure 4:
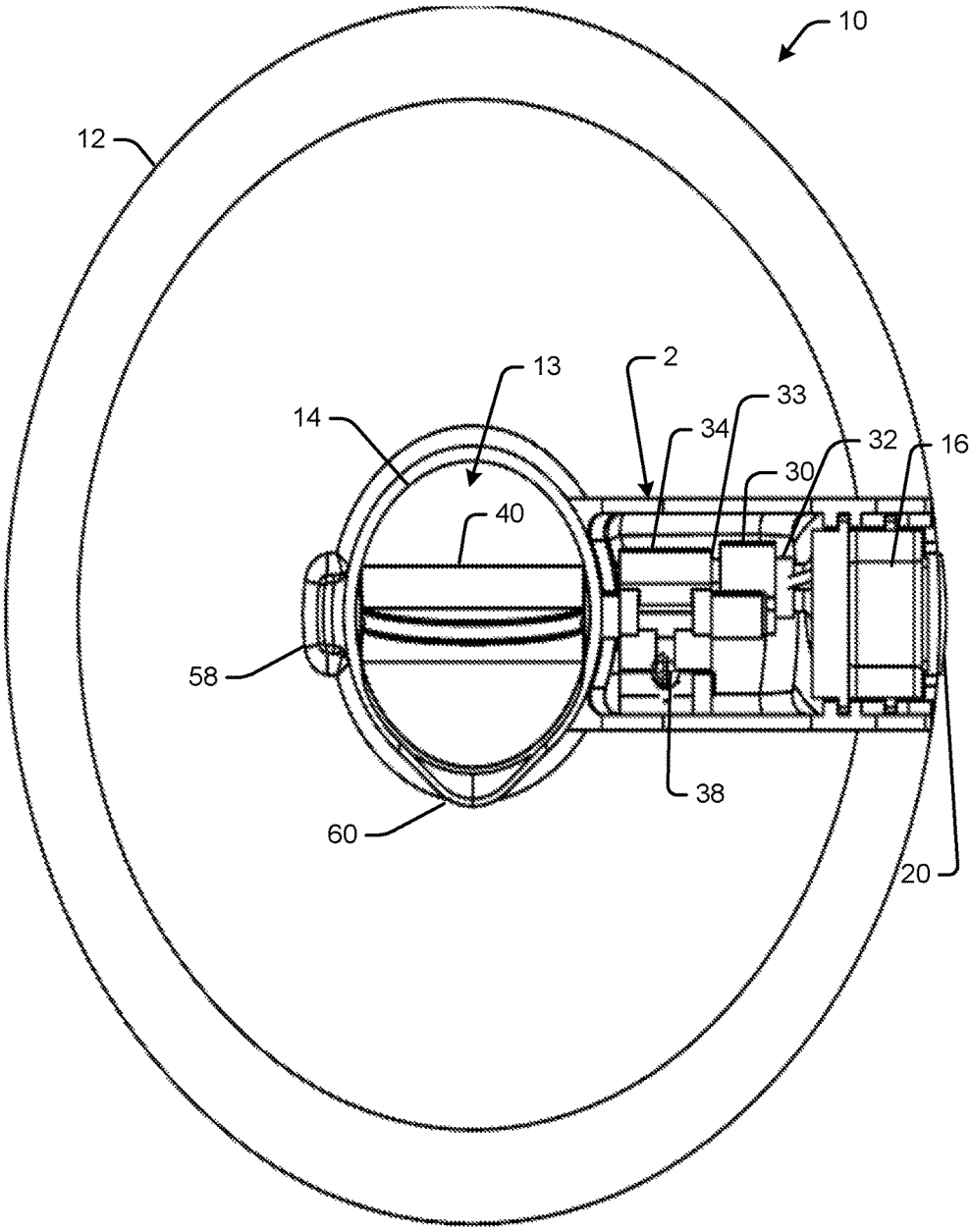
FIG. 4 is a top view of the example bottle device in an open configuration corresponding to FIG. 3.

FIG. 1 is a perspective view of an example bottle device 10 in a closed and unlocked configuration. FIG. 2 is a top view of the example bottle device 10 in a closed and unlocked configuration corresponding to FIG. 1. FIG. 3 is a perspective view of the example bottle device in an open and unlocked configuration. FIG. 4 is a top view of the example bottle device in an open configuration corresponding to FIG. 3.

In an example, the bottle device 10 may be implemented to contain a liquid. The example bottle device 10 has housing 12 with an opening 13 to selectively release the liquid. The example bottle device 10 includes a cover 14. A switch 16 is operably connected to the cover 14, wherein depressing the switch 16 opens the cover 14, and releasing the switch 16 closes the cover 14.

The cover 14 may be disc-shaped. In an example, the cover 14 has a seal 15 (e.g., a molded seal on the outer periphery of the disc). The seal 15 may be a molded silicone. Of course, the cover 14 and seal 15 are not limited to any particular size or shape. In addition, the cover 14 and seal 15 may be manufactured of any suitable material.

Before continuing, it should be noted that the examples described above are provided for purposes of illustration, and are not intended to be limiting. Other devices and/or device configurations may be utilized to carry out the operations described herein.

Figure 5:
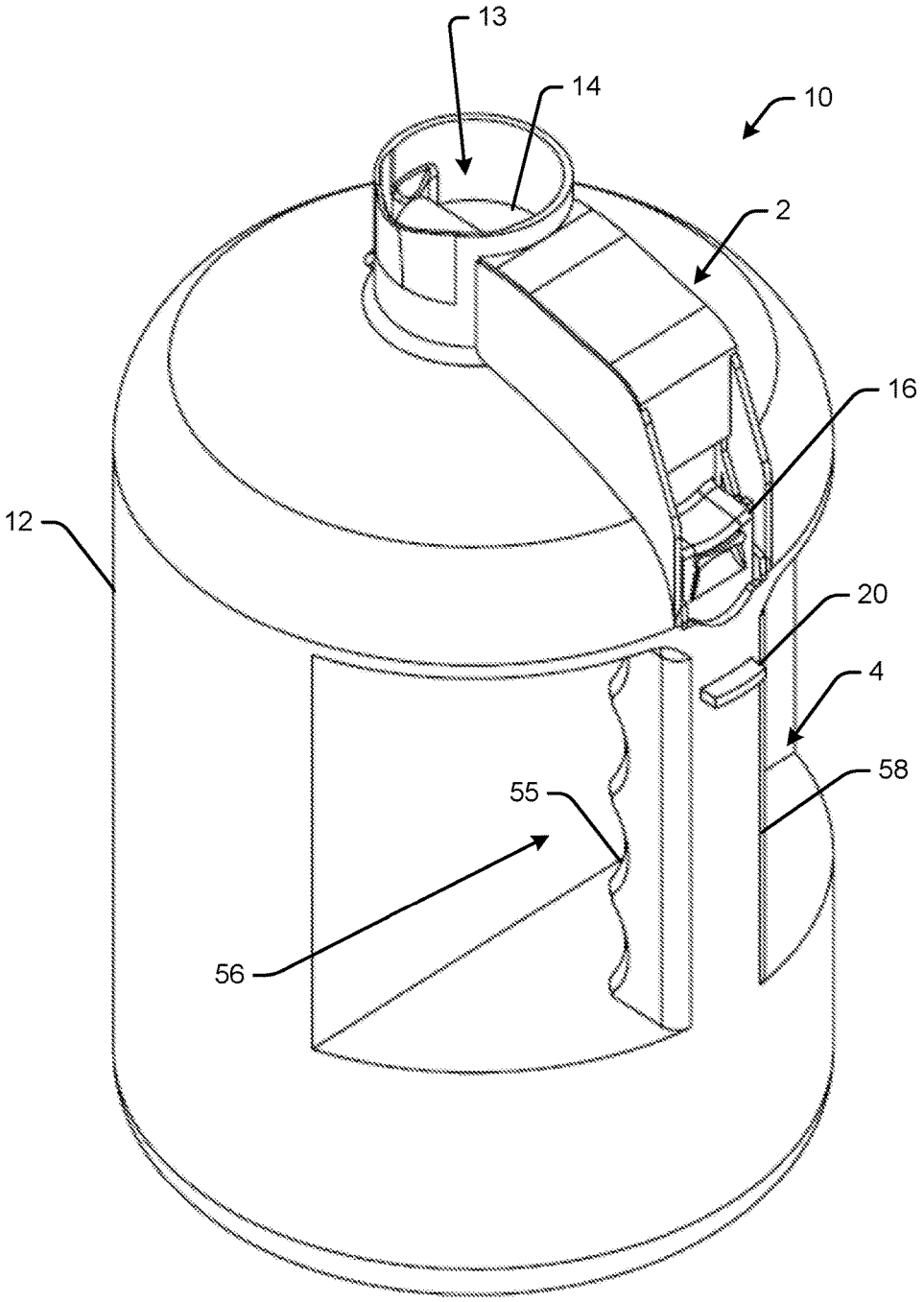
FIG. 5 is a perspective view of an example bottle device in a closed and locked configuration.
Figure 6:
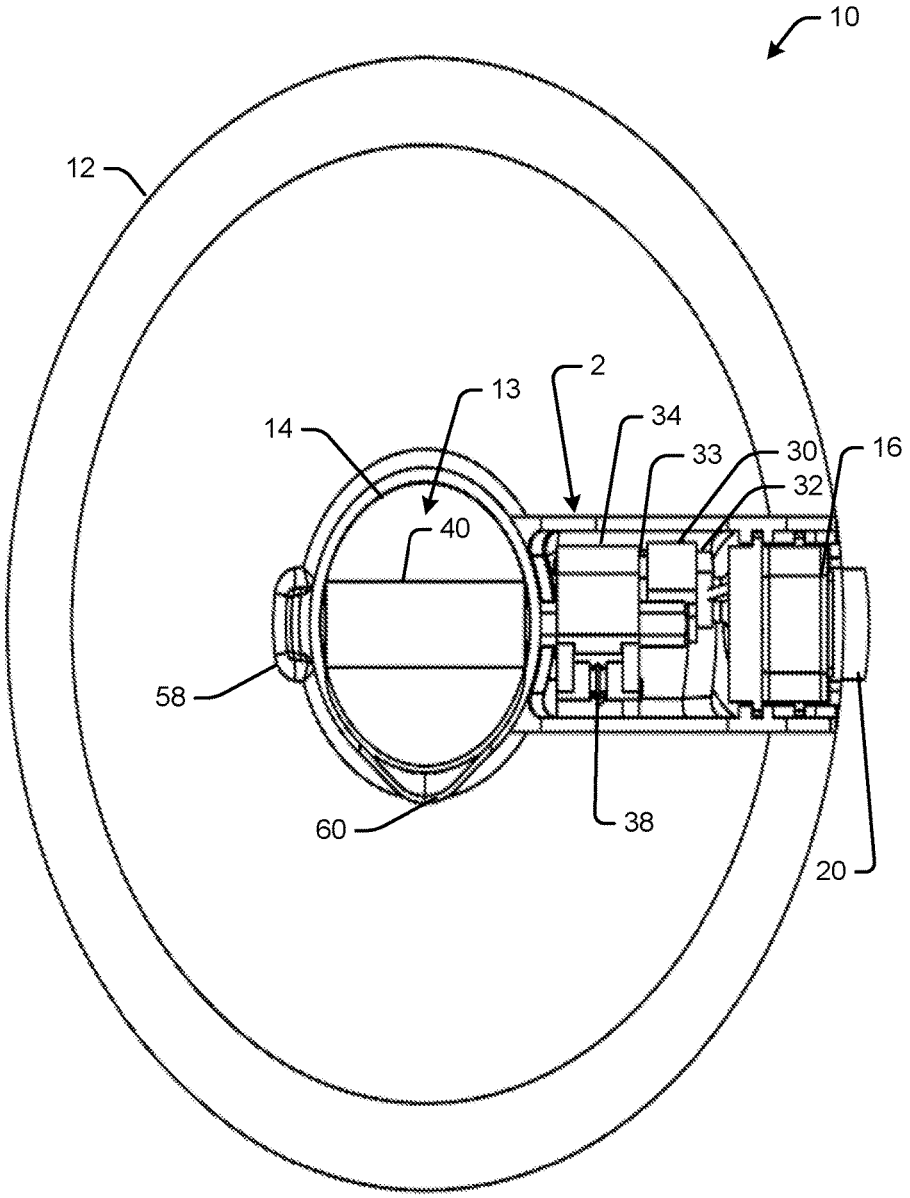
FIG. 6 is a top view of the example bottle device in a closed and unlocked configuration corresponding to FIG. 5.

FIG. 5 is a perspective view of an example bottle device in a closed and locked configuration. FIG. 6 is a top view of the example bottle device in a closed and unlocked configuration corresponding to FIG. 5. The lock mechanism 18 is operable to secure the switch 16 with the cover 14 in the closed position. In an example, the lock mechanism 18 applies pressure against the lock block 52, thereby extending a release 20 that can be slid sideways in either direction and latched into a locked position to hold the switch 16 in the depressed position (and hence the cover 14 in the closed position). A release 20 is configured to extend through an opening 22 in the housing 12 in the locked position. The lock mechanism 18 may be manually actuated (e.g., by sliding) to retract the release 20 back into the opening 22 and into the housing 12 to release the switch 16 from the locked position so that the switch 16 can be moved upward (e.g., under bias of the spring 38).

In an example, the bottle device 10 has an upper handle portion 2 and a lower handle portion 4 of the housing 12. A hand grip 55 may be formed on an opening side 56 of the handle 58 on the lower handle portion 4 of the housing 12. The switch 16 may be positioned in the lower handle portion 4 of the housing 12. Switch linkage described below may be positioned in the upper handle portion 2 of the housing 12.

Figure 7:
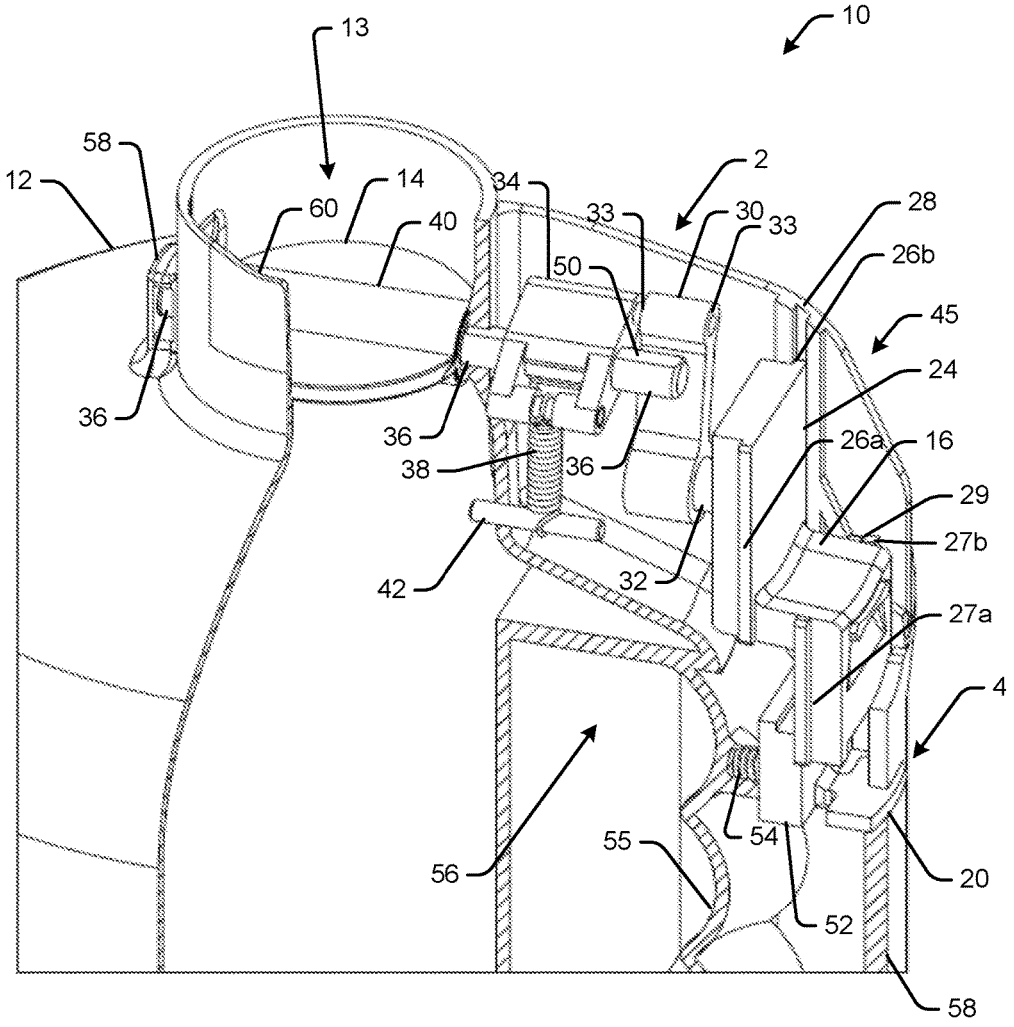
FIG. 7 is a partial cut-away view of the example bottle device showing the switch mechanism.

FIG. 7 is a partial cut-away view of the example bottle device showing an example switch mechanism 45. In an example, the switch mechanism 45 includes a plurality of linkages that to drive a shaft which operates opening and closing of the cover 14. The linkages may be interconnected by shafts or pins secured by a retaining ring or other suitable fastening mechanism. In an example having three linkages, the switch mechanism 45 can be said to have a "triple offset design" which when connected to the cover 14, operate similar to a butterfly valve.

In an example of the switch mechanism 45, the switch 16 is operably connected to the cover 14 via a switch arm 24. The switch arm 24 is slidably engaged by rails 26*a* and 26*b* in a channel 28, and by rails 27*a* and 27*b* in a channel 29 in the housing 12, such that the switch arm 24 moves up and down in response to depressing and releasing the switch 16. The switch arm 24 engages a secondary or connecting arm 30 via shaft 32. The switch arm 24 also engages a primary link arm 34, which is connected to the cover 14 via primary shaft 36. In an example, the primary link arm 34 has a flat side, which engages a flat portion within enclosed cylinder 40 of the cover 14 so as to cause the cover 14 to rotate with the primary shaft 36. The primary shaft 36 may extend through the cover 14 and be pivotally secured to outside mount 58. Of course, other mechanisms for attaching the primary shaft 36 to the cover 14 are also contemplated.

The primary link arm 34 moves in response to movement of the switch arm 24, as it may be actuated by the switch 16. As such, movement of the switch 16 between a first position (e.g., depressed position) and a second position (e.g., released position) correspond to an open position and a closed position, respectively, of the cover 14.

In an example, the primary shaft 36 is loaded by a torsion spring 38 that is about 360 degrees at rest. The torsion spring 38 may be attached via a mount 42 connected to the housing 12. In another example, the torsion spring 38 may be directly connected to the housing 12. The torsion spring 38 biases the cover 14 in a closed position. The torsion spring 38 may be opened by about 90 degrees at the time of the cover 14 seating, and may be opened by about 180 degrees when the switch 16 is depressed all the way down such that the cover 14 is rotated substantially perpendicular (e.g., so that the opening 13 is "wide open"), allowing flow of the liquid to pass through the opening 13. Edge of the opening may include a formed mouthpiece or pour spout 60 for drinking from.

In an example, the switch mechanism 45 enables open/closing the cover 14, providing a wide mouth opening for easy, fast consumption (e.g., "gulping") of the liquid in the bottle device 10. It is apparent that during example operation, the user only needs one hand to operate the bottle (although operation is not limited to one-handed operation).

The operations shown and described herein are provided only to illustrate example implementations of the bottle device. The operations are not limited to the ordering shown. Still other operations may also be implemented.

Figure 8:
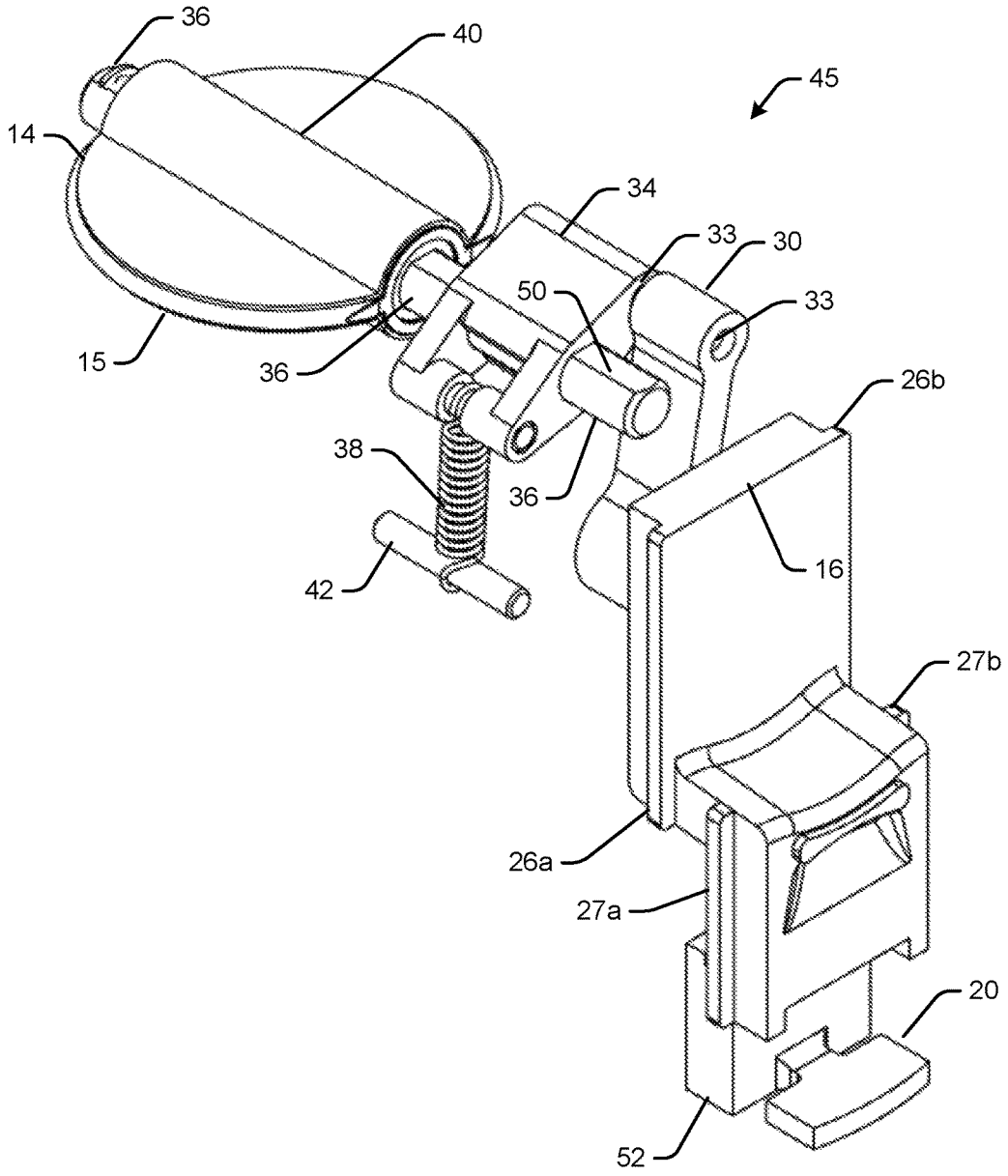
FIG. 8 is a top perspective view of a switch mechanism of the example bottle device in a closed and unlocked configuration.
Figure 9:
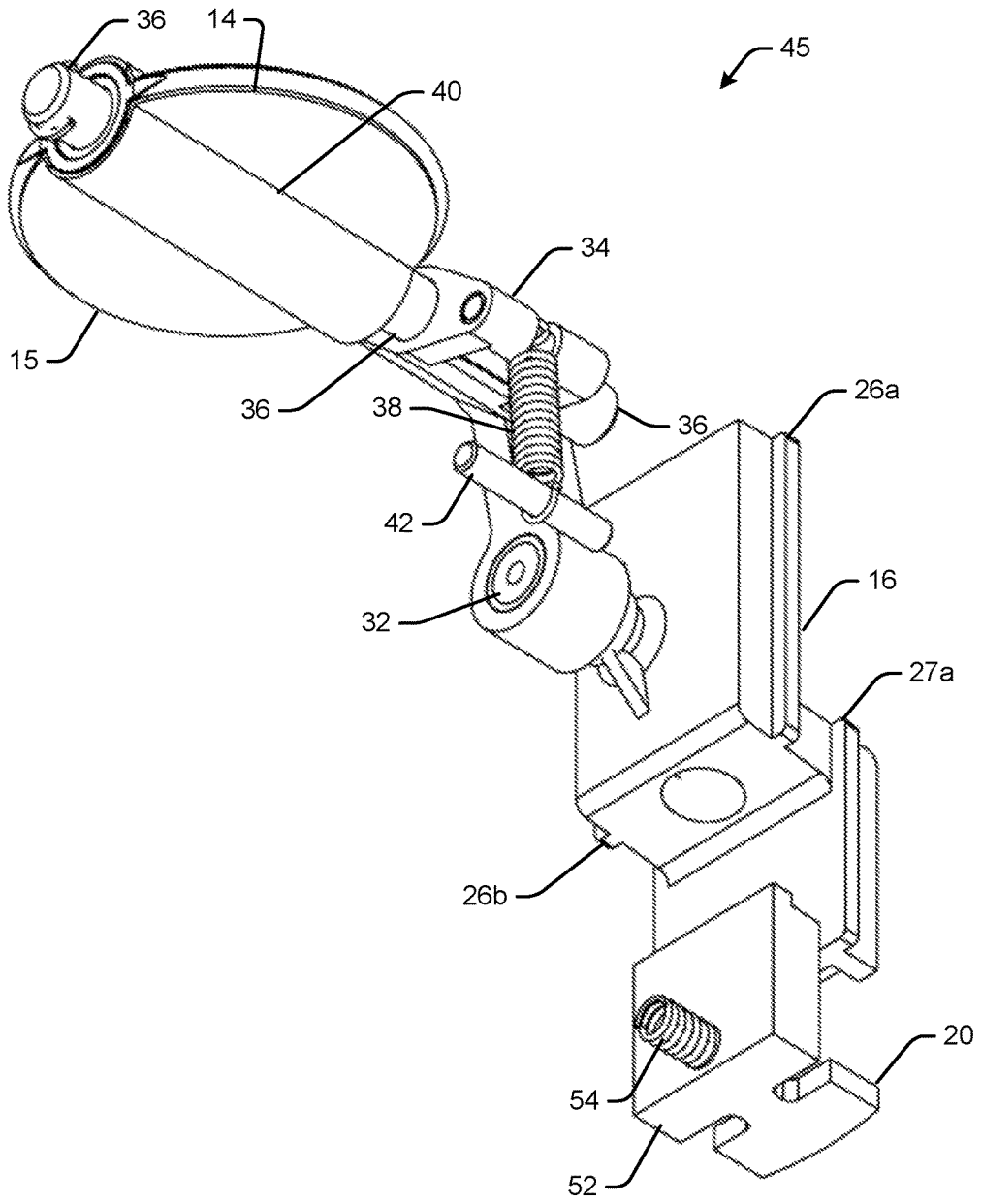
FIG. 9 is a bottom perspective view of the switch mechanism of the example bottle device in a closed and unlocked configuration corresponding to FIG. 8.
Figure 10:
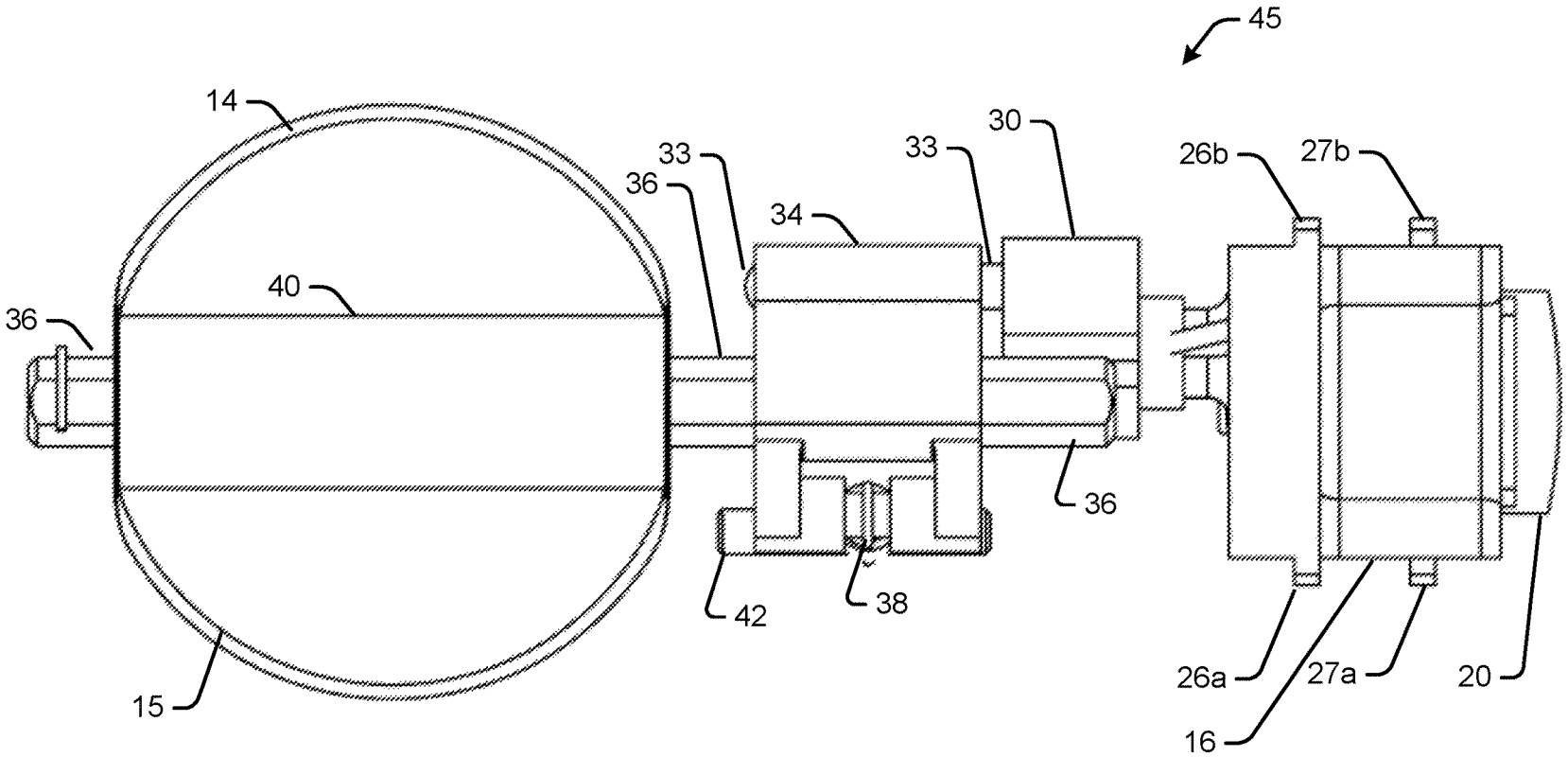
FIG. 10 is a top view of the switch mechanism of the example bottle device in a closed and unlocked configuration corresponding to FIG. 8.
Figure 11:
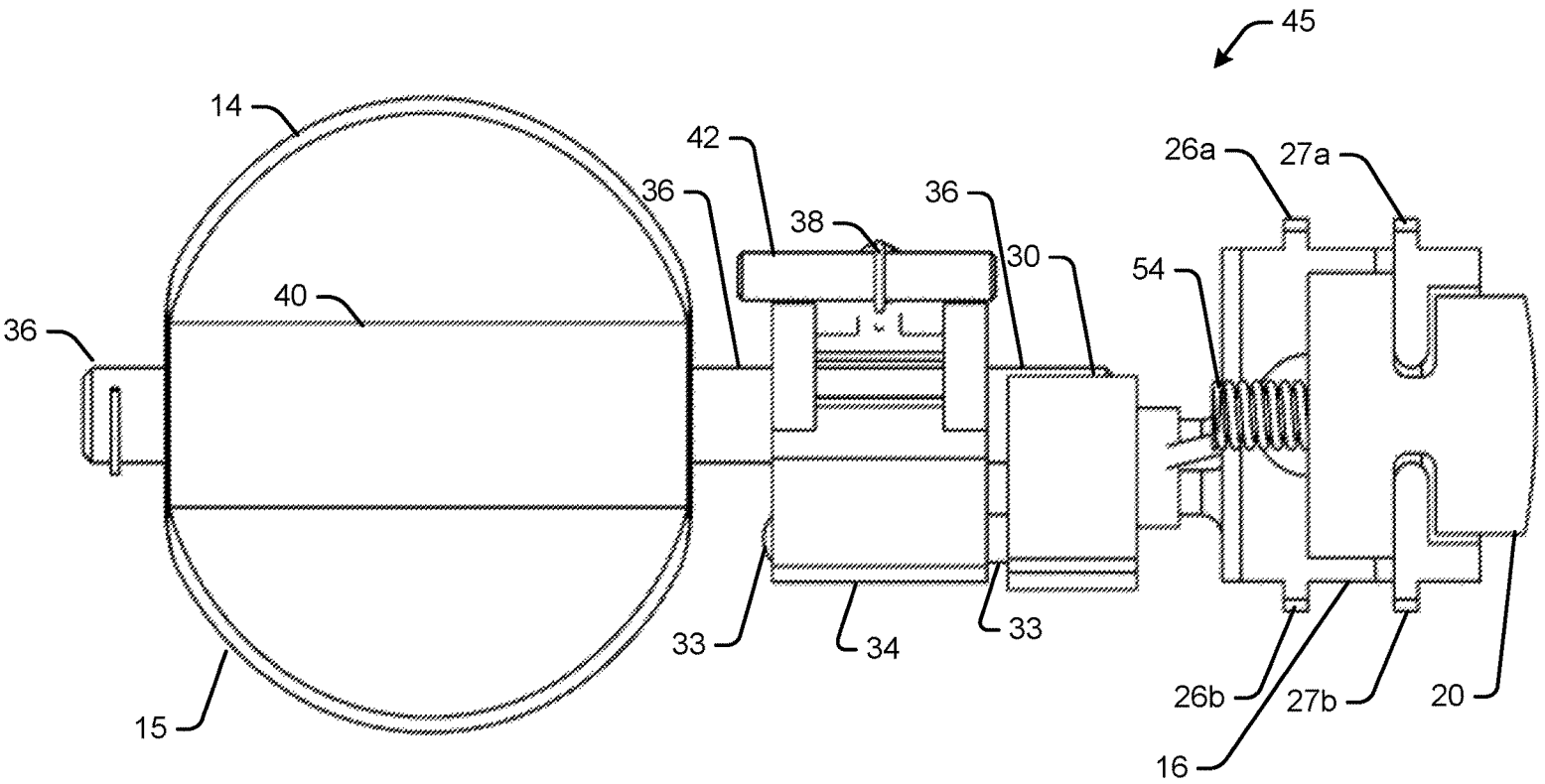
FIG. 11 is a bottom view of the switch mechanism of the example bottle device in a closed and unlocked configuration corresponding to FIG. 8.
Figure 12:
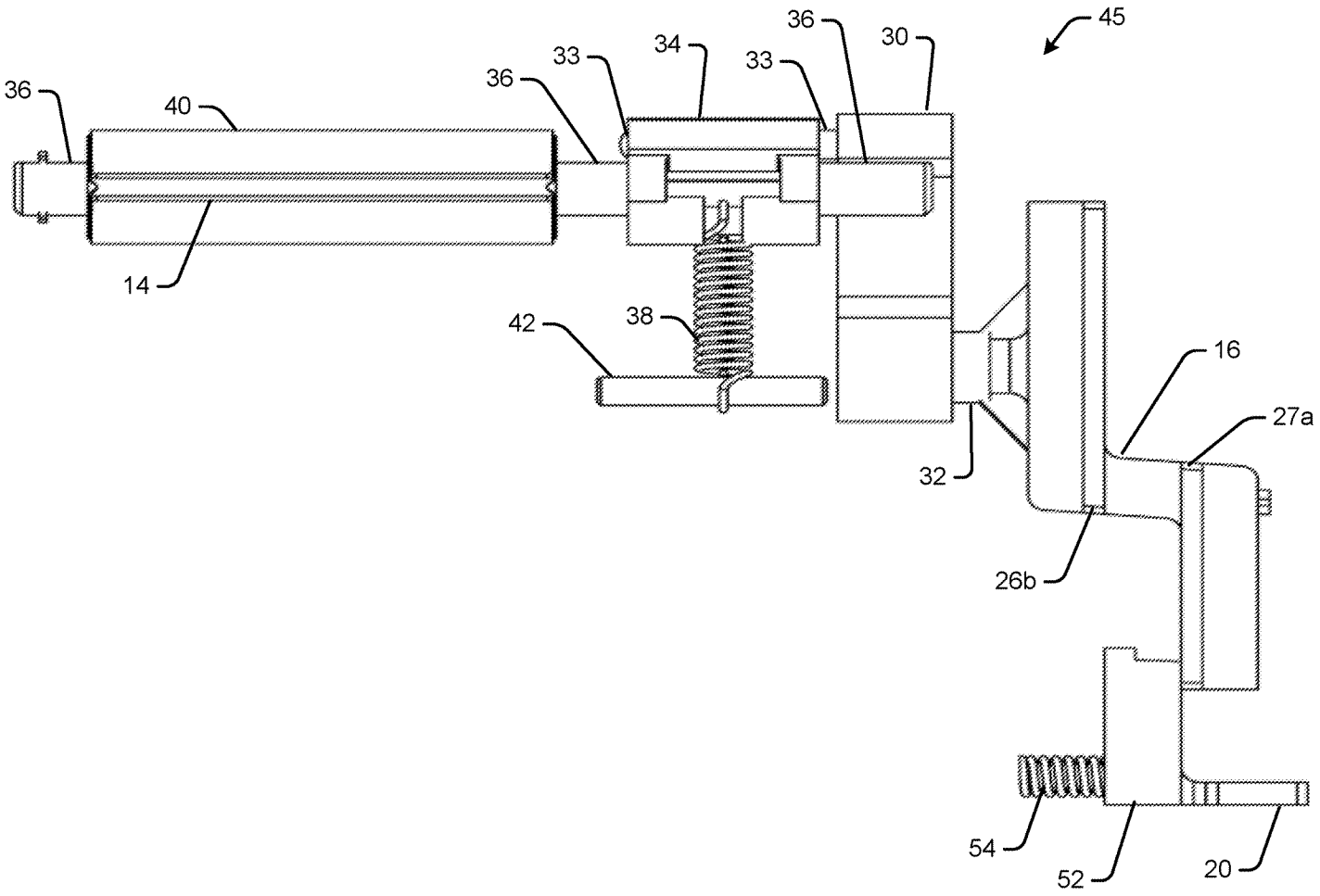
FIG. 12 is a side view of a switch mechanism of the example bottle device in a closed and unlocked configuration corresponding to FIG. 8.
Figure 13:
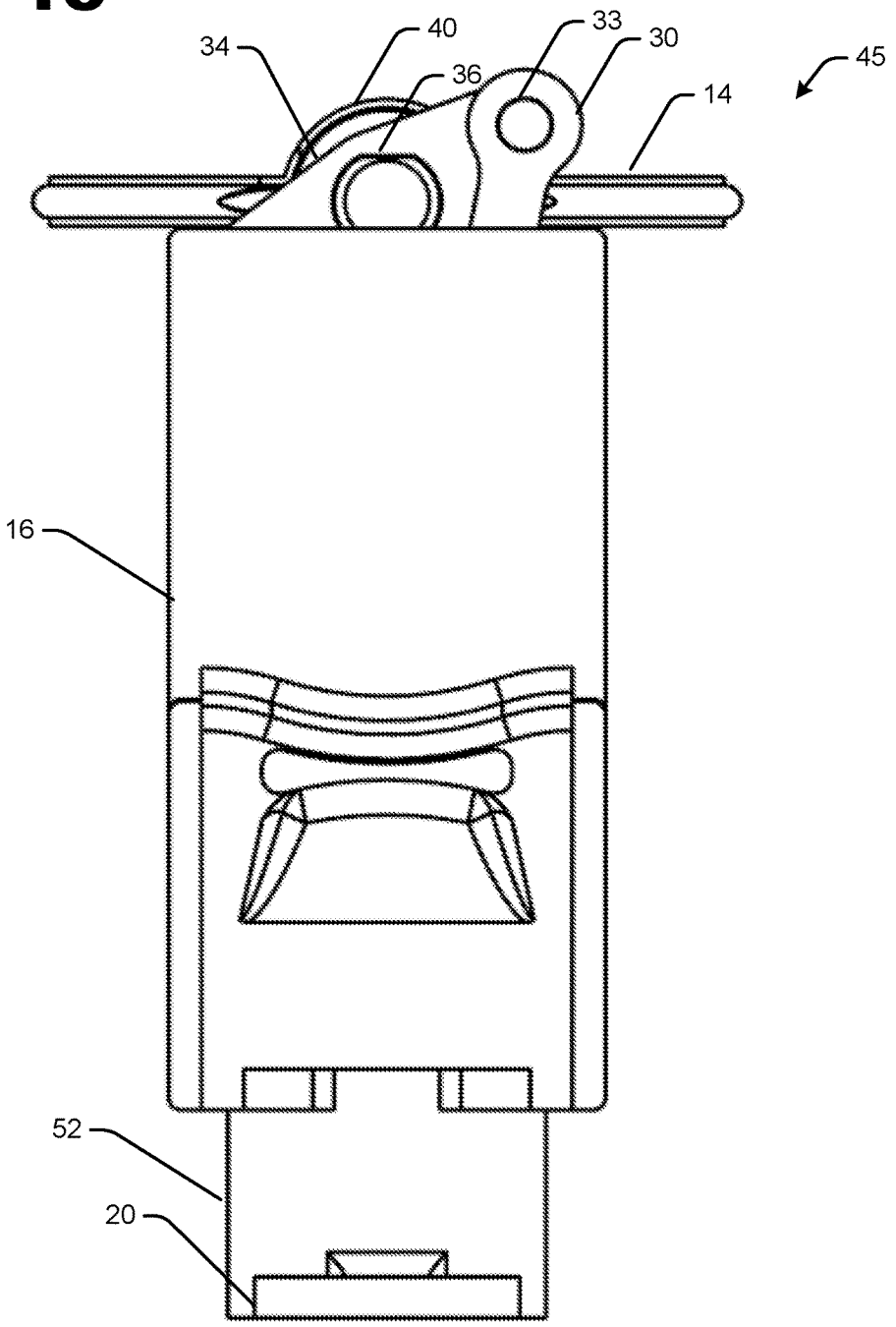
FIG. 13 is a front view of the switch mechanism of the example bottle device in a closed and unlocked configuration corresponding to FIG. 8.

FIG. 8 is a top perspective view of a switch mechanism 45 of the example bottle device 10 in a closed and unlocked configuration. FIG. 9 is a bottom perspective view of the switch mechanism 45 of the example bottle device 10 in a closed and unlocked configuration corresponding to FIG. 8. FIG. 10 is a top view of the switch mechanism 45 of the example bottle device 10 in a closed and unlocked configuration corresponding to FIG. 8. FIG. 11 is a bottom view of the switch mechanism 45 of the example bottle device 10 in a closed and unlocked configuration corresponding to FIG. 8. FIG. 12 is a side view of a switch mechanism 45 of the example bottle device 10 in a closed and unlocked configuration corresponding to FIG. 8. FIG. 13 is a front view of the switch mechanism 45 of the example bottle device 10 in a closed and unlocked configuration corresponding to FIG. 8.

Figure 14:
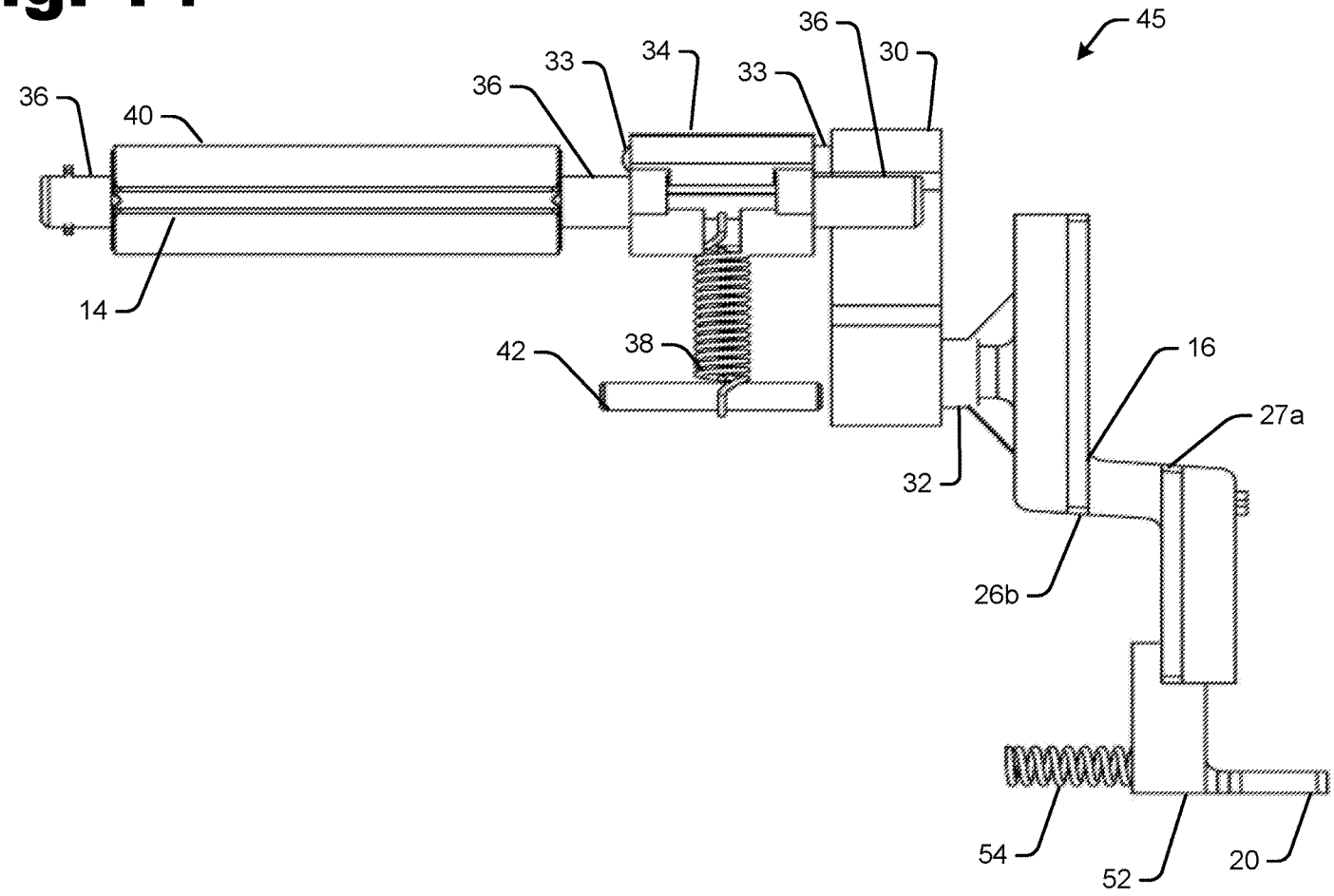
FIG. 14 is a side view of the switch mechanism of the example bottle device in a closed and locked configuration.

FIG. 14 is a side view of the switch mechanism 45 of the example bottle device in a closed and locked configuration. For example, lock mechanism 18 may be secured so that the cover 14 does not inadvertently open during carrying of the bottle device 10.

Figure 15:
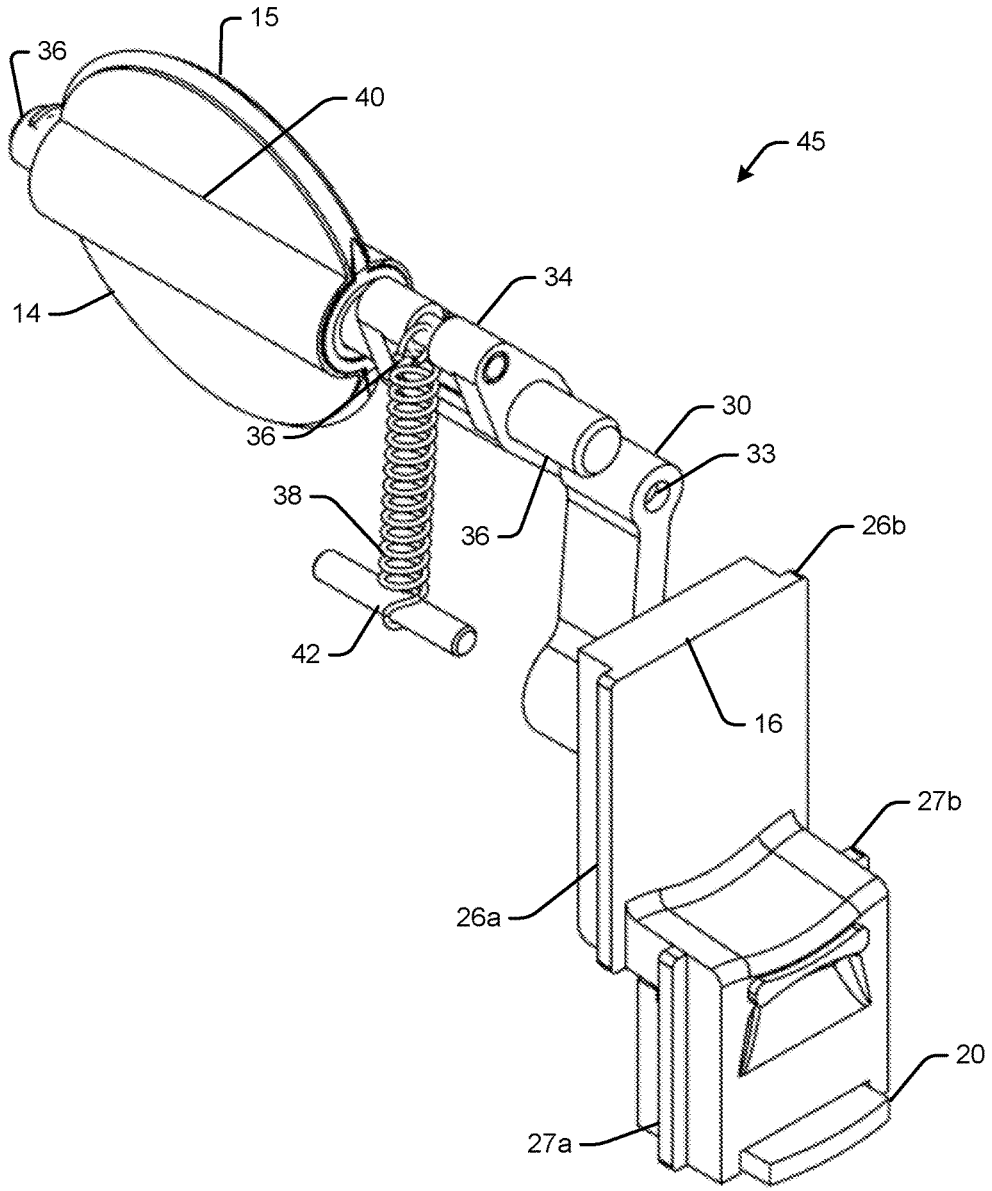
FIG. 15 is a top perspective view of a switch mechanism of the example bottle device in an open configuration.
Figure 16:
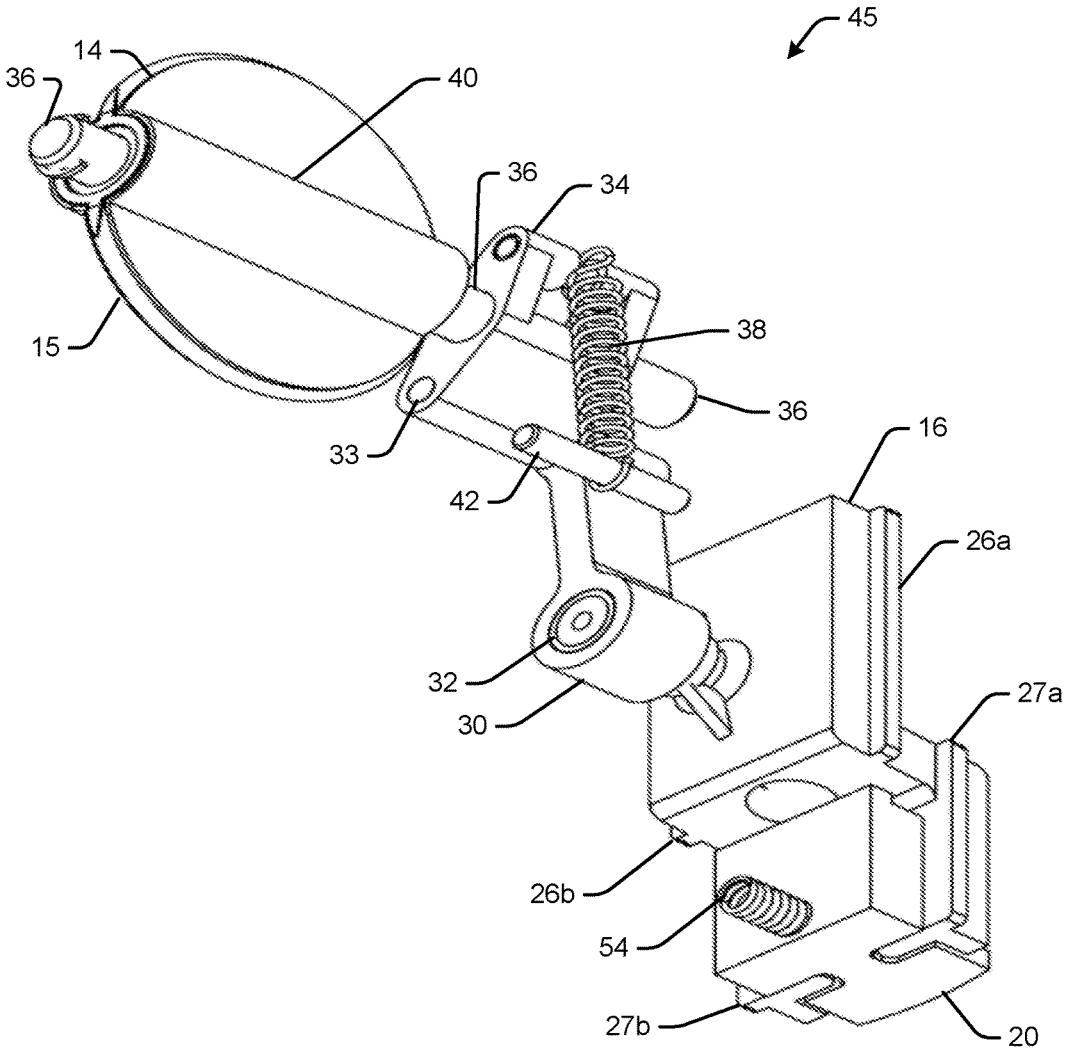
FIG. 16 is a bottom perspective view of the switch mechanism of the example bottle device in an open configuration corresponding to FIG. 15.
Figure 17:
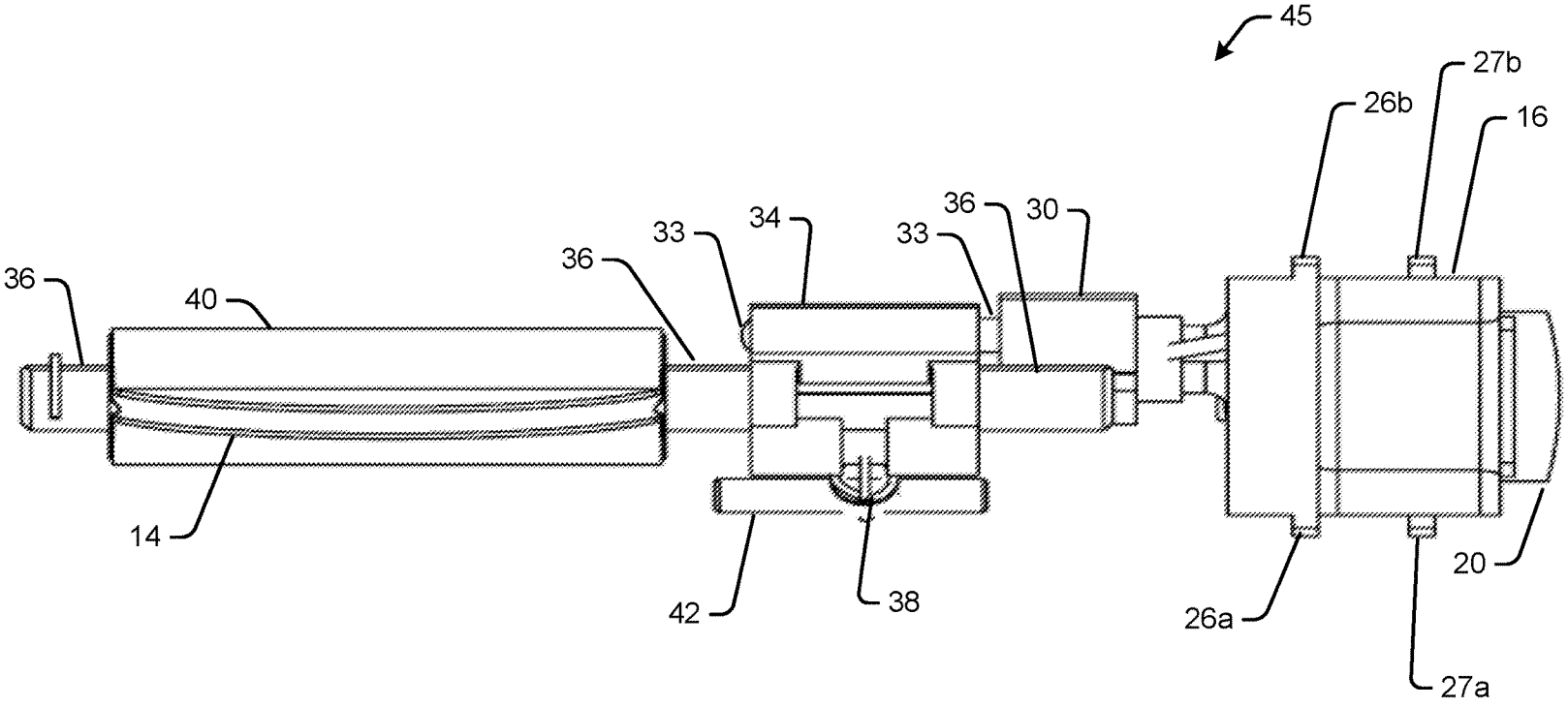
FIG. 17 is a top view of the switch mechanism of the example bottle device in an open configuration corresponding to FIG. 15.
Figure 18:
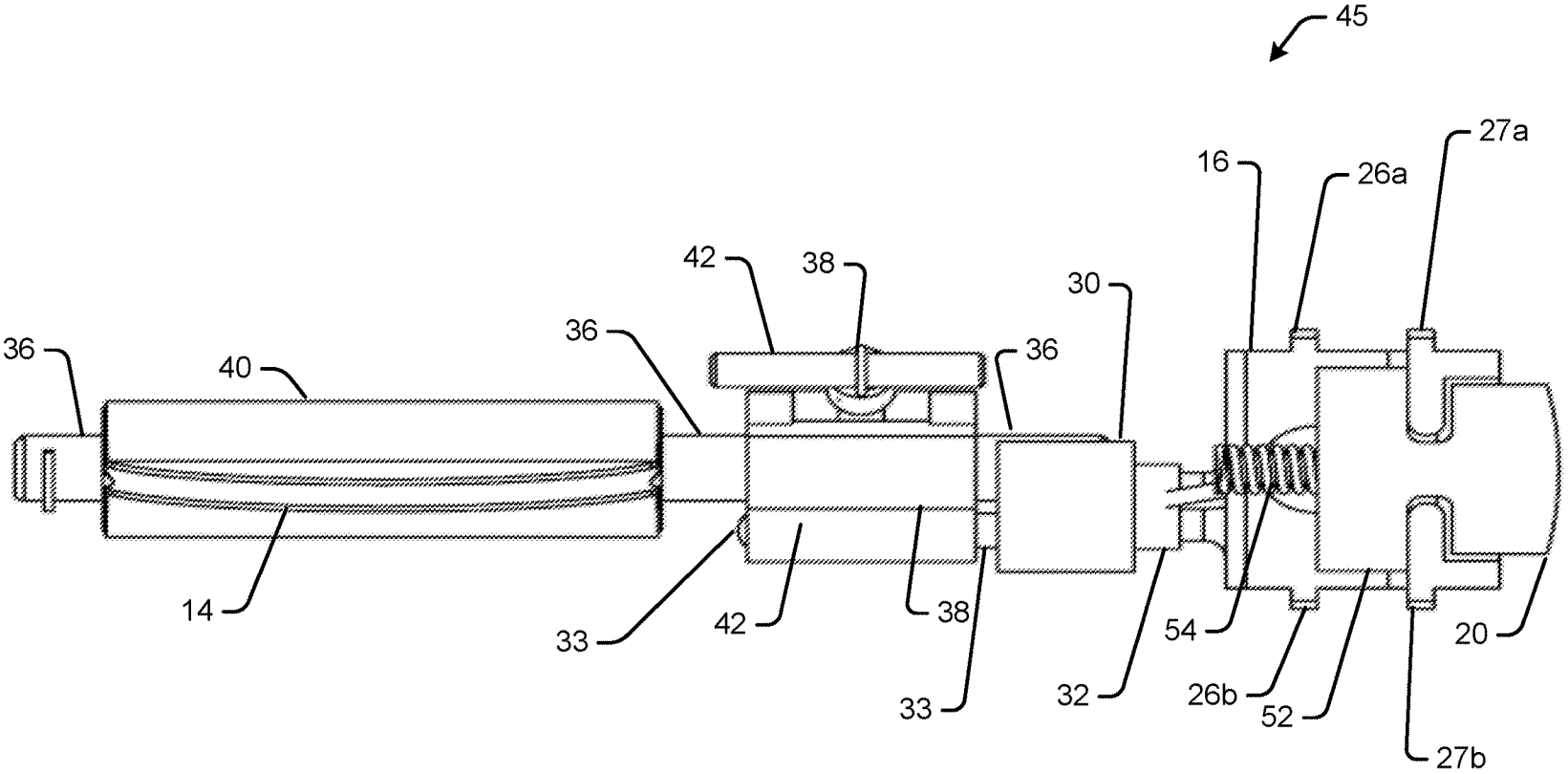
FIG. 18 is a bottom view of the switch mechanism of the example bottle device in an open configuration corresponding to FIG. 15.
Figure 19:
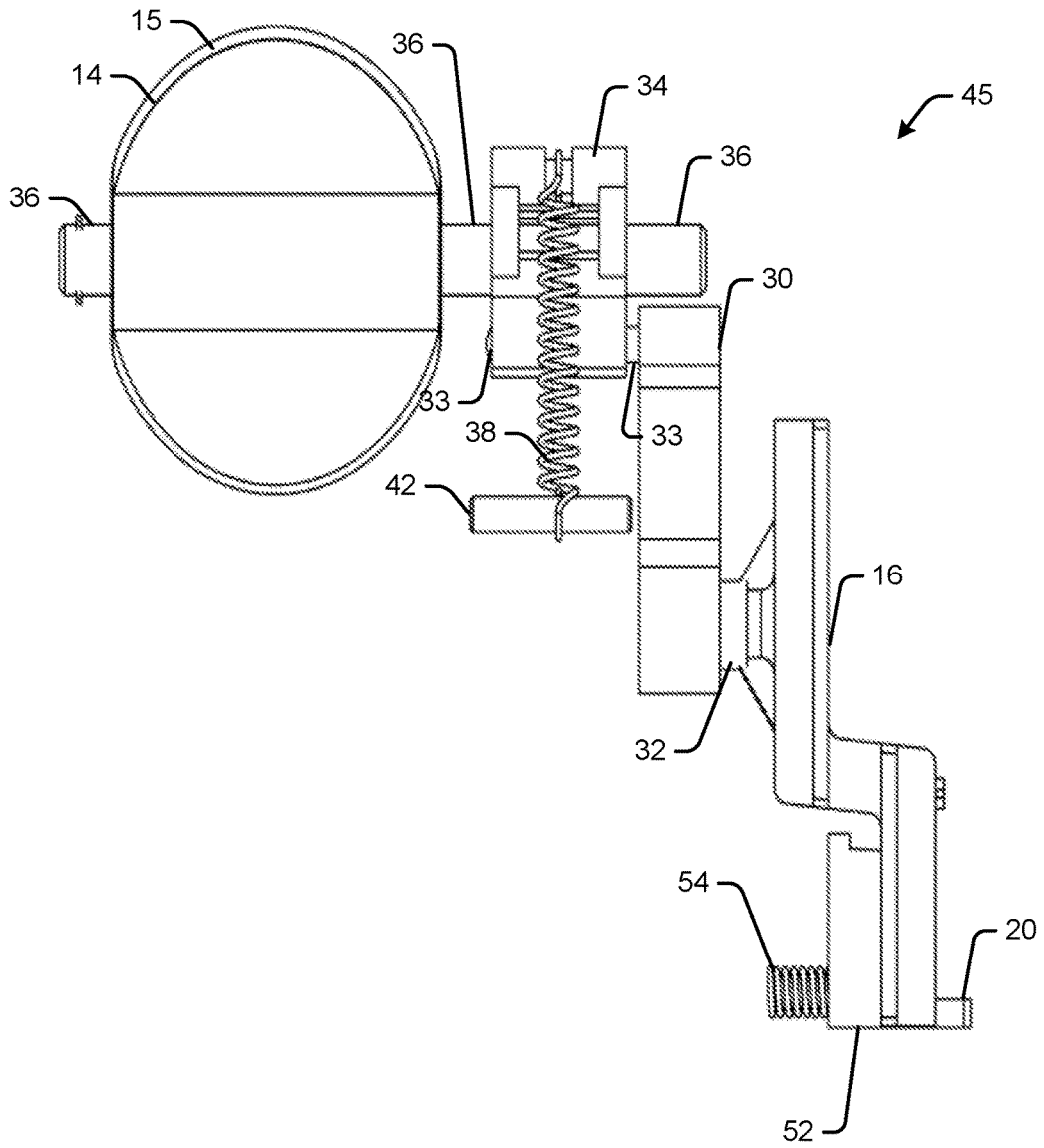
FIG. 19 is a side view of a switch mechanism of the example bottle device in an open configuration corresponding to FIG. 15.
Figure 20:
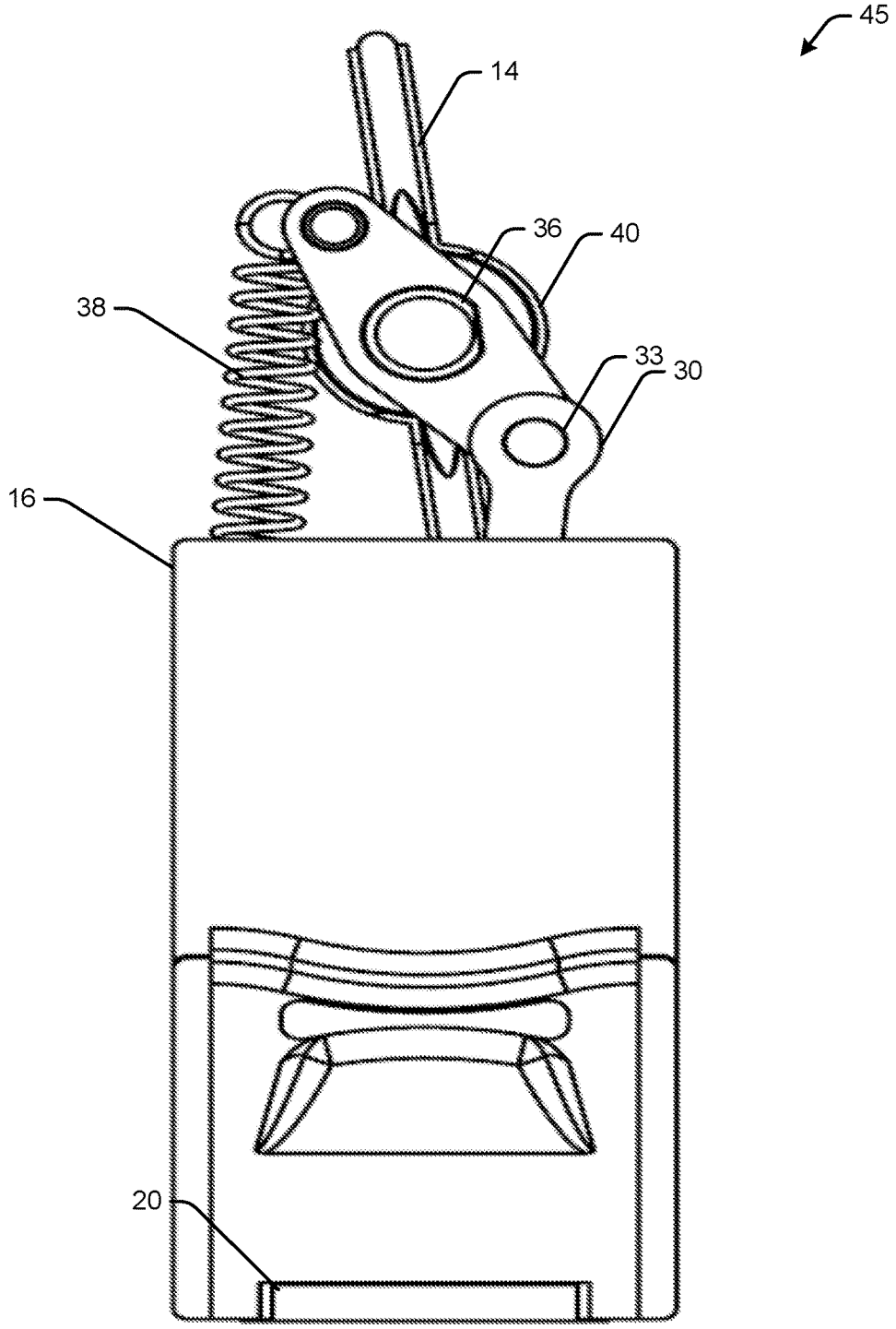
FIG. 20 is a front view of the switch mechanism of the example bottle device in an open configuration corresponding to FIG. 15.

FIG. 15 is a top perspective view of a switch mechanism 45 of the example bottle device 10 in an open configuration. FIG. 16 is a bottom perspective view of the switch mechanism 45 of the example bottle device 10 in an open configuration corresponding to FIG. 15. FIG. 17 is a top view of the switch mechanism 45 of the example bottle device 10 in an open configuration corresponding to FIG. 15. FIG. 18 is a bottom view of the switch mechanism 45 of the example bottle device 10 in an open configuration corresponding to FIG. 15. FIG. 19 is a side view of a switch mechanism 45 of the example bottle device 10 in an open configuration corresponding to FIG. 15. FIG. 20 is a front view of the switch mechanism 45 of the example bottle device 10 in an open configuration corresponding to FIG. 15.

In an example of the switch mechanism 45, the switch 16 is operably connected to the cover 14 via a switch arm 24. The switch arm 24 is slidably engaged by rails 26*a* and 26*b* in a channel 28 in the housing 12, such that the switch arm 24 moves up and down in response to depressing and releasing the switch 16. The switch arm 24 engages a secondary or connecting arm 30 via shaft 32. The connecting arm 30 is pivotally connected on one end to the switch arm 24, and the connecting arm 30 is pivotally connected on a second end to the primary link arm 34. For example, the connecting arm 30 may be pivotally connected to the switch arm 24 by first shaft 32, and the connecting arm 30 may be pivotally connected to the primary link arm 34 by a second shaft 33. The primary link arm 34 is connected to the cover 14 via primary shaft 36. In operation, the primary shaft 36 rotates the cover 14. Other examples of a switch mechanism are also contemplated as will be readily understood by those having ordinary skill in the art after becoming familiar with the teachings herein.

In an example, the primary shaft 36 has at least one flat surface 50 to engage the primary link arm 34 and the cover 14 so that the primary link arm 34 and the cover 14 rotate together. Other examples to connect the primary shaft 36 to the cover 14 are also contemplated, as will be readily understood by those having ordinary skill in the art after becoming familiar with the teachings herein.

In an example, the torsion spring 38 is mounted on one end to the housing 12 (e.g., via mount 42) and on another end to the primary link arm 34. The torsion spring 38 automatically biases the primary link arm 34 to a default position wherein the cover 14 is in the closed position. Other examples of a biasing mechanism are also contemplated, as will be readily understood by those having ordinary skill in the art after becoming familiar with the teachings herein.

In an example, the switch mechanism 45 includes a lock mechanism 18 to secure the switch 16 and maintain the cover 14 in the closed position. In an example, the lock mechanism 18 may include a lock block 52 to apply pressure against the switch 16. A lock spring 54 may be connected on one end to the housing 12 and on another end to the lock block 52. The lock spring 54 applies pressure against the switch 16 in a locked position. A release 20 may be configured to extend through an opening 22 in the housing 12 and maintain the switch 16 in a locked position. The lock mechanism 18 may be manually actuated so that the release 20 retracts through the opening 22 and into the housing 12 to release the switch 16 from the locked position. Other examples of a lock mechanism 18 are also contemplated, as will be readily understood by those having ordinary skill in the art after becoming familiar with the teachings herein.

It is noted that the examples shown and described are provided for purposes of illustration and are not intended to be limiting. Still other examples are also contemplated.

The invention claimed is:

1. A bottle device, comprising:

a housing to contain a liquid therein;

an opening in the housing;

a cover rotating between an open position and a closed position over the opening to selectively release the liquid from the housing;

a switch connected to the cover via a switch arm, a connecting arm, and a primary link arm to move the switch arm between a first position and a second position corresponding to the open position and the closed position of the cover; and a lock mechanism to secure the switch with the cover in the closed position, wherein the lock mechanism further comprises a lock block to apply pressure against the switch;

wherein the connecting arm is pivotally connected on one end to the switch arm, and the connecting arm is pivotally connected on a second end to the primary link arm.

2. The bottle device of claim 1, wherein the connecting arm is pivotally connected to the switch arm by first shaft, and the connecting arm is pivotally connected to the primary link arm by a second shaft.

3. The bottle device of claim 1, further comprising a primary shaft to rotate the cover.

4. The bottle device of claim 3, wherein the primary shaft has at least one flat surface to engage the primary link arm and the cover so that the primary link arm and the cover rotate together.

5. The bottle device of claim 1, further comprising a torsion spring mounted on one end to the housing and on another end to the primary link arm, the torsion spring automatically biasing the primary link arm to a default position wherein the cover is in the closed position.

6. The bottle device of claim 1, wherein the lock mechanism further comprises a lock spring connected on one end to the housing and on another end to the lock block, the lock spring applying pressure against the switch in a locked position.

7. The bottle device of claim 1, wherein the lock mechanism further comprises a release configured to extend through an opening in the housing in a locked position, the lock mechanism manually actuated to retract through the opening in the housing to release the switch from the locked position.

8. The bottle device of claim 1, further comprising an upper handle portion and a lower handle portion of the housing.

9. The bottle device of claim 8, wherein the switch is positioned in the lower handle portion of the housing.

10. The bottle device of claim 8, wherein the connecting arm and the primary link arm are both positioned in the upper handle portion of the housing.

11. The bottle device of claim 8, further comprising a hand grip formed on the lower handle portion of the housing.

12. A bottle device to contain a liquid having an opening to selectively release the liquid, the bottle device comprising:

a cover;

a switch arm;

a connecting arm;

a primary link arm;

a switch operably connected to the cover via the switch arm, the connecting arm, and the primary link arm, wherein depressing the switch moves the switch arm to open the cover, and releasing the switch moves the switch arm to close the cover; and a primary shaft to rotate the cover, the primary shaft has at least one flat surface to engage the primary link arm and the cover so that the primary link arm and the cover rotate together;

wherein the connecting arm is pivotally connected to the switch arm by first shaft, and the connecting arm is pivotally connected to the primary link arm by a second shaft.

13. The bottle device of claim 12, further comprising a torsion spring mounted on one end to the housing and on another end to the primary link arm, the torsion spring automatically biasing the primary link arm to a default position wherein the cover is in the closed position.

14. The bottle device of claim 12, further comprising a lock mechanism to secure the switch with the cover in the closed position, the lock mechanism comprising:

a lock block to apply pressure against the switch;

a lock spring connected on one end to the housing and on another end to the lock block, the lock spring applying pressure against the switch in a locked position; and a release configured to extend through an opening in the housing in a locked position, the lock mechanism manually actuated to retract through the opening in the housing to release the switch from the locked position.

15. The bottle device of claim 12, further comprising an upper handle portion and a lower handle portion of the housing, wherein:

the switch is positioned in the lower handle portion of the housing;

the connecting arm and the primary link arm are both positioned in the upper handle portion of the housing; and a hand grip is formed on the lower handle portion of the housing.

16. A bottle device, comprising:

a housing to contain a liquid therein;

an opening in the housing;

a cover rotating between an open position and a closed position over the opening to selectively release the liquid from the housing; and a switch connected to the cover via a switch arm, a connecting arm, and a primary link arm to move the switch arm between a first position and a second position corresponding to the open position and the closed position of the cover;

wherein the connecting arm is pivotally connected to the switch arm by a first shaft, and the connecting arm is pivotally connected to the primary link arm by a second shaft.

17. A bottle device, comprising:

a housing to contain a liquid therein;

an opening in the housing;

a cover rotating between an open position and a closed position over the opening to selectively release the liquid from the housing;

a switch connected to the cover via a switch arm, a connecting arm, and a primary link arm to move the switch arm between a first position and a second position corresponding to the open position and the closed position of the cover; and a primary shaft to rotate the cover;

wherein the primary shaft has at least one flat surface to engage the primary link arm and the cover so that the primary link arm and the cover rotate together.

18. A bottle device, comprising:

a housing to contain a liquid therein;

an opening in the housing;

a cover rotating between an open position and a closed position over the opening to selectively release the liquid from the housing;

a switch connected to the cover via a switch arm, a connecting arm, and a primary link arm to move the switch arm between a first position and a second position corresponding to the open position and the closed position of the cover; and a torsion spring mounted on one end to the housing and on another end to the primary link arm, the torsion spring automatically biasing the primary link arm to a default position wherein the cover is in the closed position.

19. A bottle device, comprising:

a housing to contain a liquid therein;

an opening in the housing;

a cover rotating between an open position and a closed position over the opening to selectively release the liquid from the housing;

a switch connected to the cover via a switch arm, a connecting arm, and a primary link arm to move the switch arm between a first position and a second position corresponding to the open position and the closed position of the cover; and a lock mechanism to secure the switch with the cover in the closed position;

wherein the lock mechanism further comprises a lock block to apply pressure against the switch.

20. A bottle device, comprising:

a housing to contain a liquid therein;

an opening in the housing;

a cover rotating between an open position and a closed position over the opening to selectively release the liquid from the housing;

a switch connected to the cover via a switch arm, a connecting arm, and a primary link arm to move the switch arm between a first position and a second position corresponding to the open position and the closed position of the cover; and a lock mechanism to secure the switch with the cover in the closed position;

wherein the lock mechanism further comprises a lock block to apply pressure against the switch;

wherein the lock mechanism further comprises a lock spring connected on one end to the housing and on another end to the lock block, the lock spring applying pressure against the switch in a locked position.

21. A bottle device, comprising:

a housing to contain a liquid therein;

an opening in the housing;

a cover rotating between an open position and a closed position over the opening to selectively release the liquid from the housing;

a switch connected to the cover via a switch arm, a connecting arm, and a primary link arm to move the switch arm between a first position and a second position corresponding to the open position and the closed position of the cover; and a lock mechanism to secure the switch with the cover in the closed position;

wherein the lock mechanism further comprises a release configured to extend through an opening in the housing in a locked position, the lock mechanism manually actuated to retract through the opening in the housing to release the switch from the locked position.

22. A bottle device to contain a liquid having an opening to selectively release the liquid, the bottle device comprising:

a cover;

a switch arm;

a connecting arm;

a primary link arm; and a switch operably connected to the cover via the switch arm, the connecting arm, and the primary link arm, wherein depressing the switch moves the switch arm to open the cover, and releasing the switch moves the switch arm to close the cover;

wherein the connecting arm is pivotally connected to the switch arm by first shaft, and the connecting arm is pivotally connected to the primary link arm by a second shaft.

23. A bottle device to contain a liquid having an opening to selectively release the liquid, the bottle device comprising:

a cover;

a switch arm;

a connecting arm;

a primary link arm;

a switch operably connected to the cover via the switch arm, the connecting arm, and the primary link arm, wherein depressing the switch moves the switch arm to open the cover, and releasing the switch moves the switch arm to close the cover; and a primary shaft to rotate the cover, the primary shaft has at least one flat surface to engage the primary link arm and the cover so that the primary link arm and the cover rotate together.

24. A bottle device to contain a liquid having an opening to selectively release the liquid, the bottle device comprising:

a cover;

a switch arm;

a connecting arm;

a primary link arm;

a switch operably connected to the cover via the switch arm, the connecting arm, and the primary link arm, wherein depressing the switch moves the switch arm to open the cover, and releasing the switch moves the switch arm to close the cover; and a torsion spring mounted on one end to the housing and on another end to the primary link arm, the torsion spring automatically biasing the primary link arm to a default position wherein the cover is in the closed position.

25. A bottle device to contain a liquid having an opening to selectively release the liquid, the bottle device comprising:

a cover;

a switch arm;

a connecting arm;

a primary link arm;

a switch operably connected to the cover via the switch arm, the connecting arm, and the primary link arm, wherein depressing the switch moves the switch arm to open the cover, and releasing the switch moves the switch arm to close the cover; and a lock mechanism to secure the switch with the cover in the closed position, the lock mechanism comprising:

a lock block to apply pressure against the switch;

a lock spring connected on one end to the housing and on another end to the lock block, the lock spring applying pressure against the switch in a locked position; and a release configured to extend through an opening in the housing in a locked position, the lock mechanism manually actuated to retract through the opening in the housing to release the switch from the locked position.

* * * * *